US010837070B2

(12) United States Patent
Schiebol

(10) Patent No.: US 10,837,070 B2
(45) Date of Patent: Nov. 17, 2020

(54) METHOD FOR HARDENING SHEET METAL MATERIAL AND HARDENED METAL SHEET MATERIAL

(71) Applicant: BLANCO GmbH + Co KG, Oberderdingen (DE)

(72) Inventor: Markus Schiebol, Pfaffenhofen-Weiler (DE)

(73) Assignee: BLANCO GmbH + Co KG, Oberderingen (DE)

( * ) Notice: Subject to any disclaimer, the term of this patent is extended or adjusted under 35 U.S.C. 154(b) by 64 days.

(21) Appl. No.: 15/958,787

(22) Filed: Apr. 20, 2018

(65) Prior Publication Data

US 2018/0237873 A1 Aug. 23, 2018

Related U.S. Application Data

(60) Division of application No. 15/056,396, filed on Feb. 29, 2016, now Pat. No. 10,000,822, which is a (Continued)

(30) Foreign Application Priority Data

Sep. 2, 2013 (DE) ..... 10 2013 217 431

(51) Int. Cl.
*B23P 9/00* (2006.01)
*C21D 7/06* (2006.01)
(Continued)

(52) U.S. Cl.
CPC ..... *C21D 7/06* (2013.01); *B24C 1/10* (2013.01); *B24C 3/10* (2013.01); *C22C 38/001* (2013.01);
(Continued)

(58) Field of Classification Search
None
See application file for complete search history.

(56) References Cited

U.S. PATENT DOCUMENTS 7,601,226 B2 10/2009 Voges et al.
2005/0160780 A1 7/2005 Kimura et al.
(Continued)

FOREIGN PATENT DOCUMENTS

DE 4018877 12/1991
DE 19952514 5/2001
(Continued)

OTHER PUBLICATIONS

Thyssenkrupp Materials, "Stainless Steel 1.4301—304 Material Data Sheet", Jan. 2018, Thyssenkrupp Materials, pp. 1-3 (Year: 2018).*
(Continued)

*Primary Examiner* — Seth Dumbris
(74) *Attorney, Agent, or Firm* — Hanley, Flight & Zimmerman, LLC

(57) ABSTRACT

In order to provide a method for hardening a metal sheet material by means of which a particularly hard and scratch-resistant surface is produced on the metal sheet material, it is proposed that the method comprises the following:

applying at least one peening stream to the metal sheet material, wherein at least one peening stream is applied to a front side of the metal sheet material and/or a rear side of the metal sheet material, respectively.

9 Claims, 3 Drawing Sheets

Related U.S. Application Data continuation of application No. PCT/EP2014/067924, filed on Aug. 22, 2014.

(51) Int. Cl.

| | |
|---|---|
| ***B24C 1/10*** | (2006.01) |
| ***B24C 3/10*** | (2006.01) |
| ***C22C 38/00*** | (2006.01) |
| ***C22C 38/02*** | (2006.01) |
| ***C22C 38/04*** | (2006.01) |
| ***C22C 38/34*** | (2006.01) |
| ***C22C 38/58*** | (2006.01) |
| *C21D 9/48* | (2006.01) |

(52) U.S. Cl.

CPC ..... *C22C 38/002* (2013.01); *C22C 38/02* (2013.01); *C22C 38/04* (2013.01); *C22C 38/34* (2013.01); *C22C 38/58* (2013.01); *C21D 9/48* (2013.01); *Y10T 29/479* (2015.01); *Y10T 428/12993* (2015.01)

(56) References Cited

U.S. PATENT DOCUMENTS

| | | | |
|---|---|---|---|
| 2015/0306736 | A1 | 10/2015 | Prezeau et al. |
| 2016/0177409 | A1 | 6/2016 | Schiebol |

FOREIGN PATENT DOCUMENTS

| | | | | |
|---|---|---|---|---|
| EP | 1495841 | | 1/2005 | |
| JP | S61257774 | | 11/1986 | |
| JP | H01312029 | | 12/1989 | |
| JP | H079025 | B2 * | 2/1995 | |
| JP | 2003211360 | | 7/2003 | |
| JP | 2006249559 | * | 9/2006 | ..... B26F 1/44 |
| WO | 2009157874 | | 12/2009 | |
| WO | 2012089989 | | 7/2012 | |

OTHER PUBLICATIONS

International Searching Authority, International Preliminary Examination Report, issued in connection with International Application No. PCT/EP2014/067924, 6 pages.

German Patent and Trademark Office, Search Report, issued in connection with German Application No. 10 2013 217 431.4, dated Sep. 16, 2013, 5 pages.

International Searching Authority, Search Report, issued in connection with International Application No. PCT/EP20141067924, 6 pages.

International Searching Authority, English translation of the International Preliminary Examination Report, issued in connection with International Application No. PCT/EP2014/067924, dated Mar. 17, 2016, 8 pages.

United States Patent and Trademark Office, Restriction Requirement issued in connection with U.S. Appl. No. 15/056,396, dated Jul. 13, 2017, 8 pages.

United States Patent and Trademark Office, Non-final Office Action issued in connection with U.S. Appl. No. 15/056,396, dated Sep. 18, 2017, 19 pages.

United States Patent and Trademark Office, Notice of Allowance issued in connection with U.S. Appl. No. 15/056,396, dated Feb. 20, 2018, 14 pages.

Canadian Patent Office, Office Action, issued in connection with Canadian Patent Application No. 2,922,443, dated Dec. 17, 2019, 4 pages.

Kopp et al., Flexible Sheet Forming Technology by Double-sided Simultaneous Shot Peen Forming, CIRP Annals—Manufacturing Technology, vol. 51, Issue 1, pp. 195-198, 2002, 4 pages.

* cited by examiner

METHOD FOR HARDENING SHEET METAL MATERIAL AND HARDENED METAL SHEET MATERIAL

RELATED APPLICATION

This application is a divisional application of U.S. patent application Ser. No. 15/056,396 filed Feb. 29, 2016, which is a continuation application of PCT/EP2014/067924 filed on Aug. 22, 2014, which claims the benefit of DE 10 2013 217 431.4, filed Sep. 2, 2013. U.S. patent application Ser. No. 15/056,396; PCT/EP2014/067924; and DE 10 2013 217 431.4 are all incorporated herein by reference in their entireties.

FIELD OF DISCLOSURE

The present invention relates to a method for hardening a metal sheet material.

BACKGROUND

Metal sheet material, in particular, stainless steel sheet material is used in particular for manufacturing kitchen worktop panels, sinks or basins.

High value is placed on the visual quality of kitchen worktops, sinks and basins; at the same time, there is a particularly high risk with these products that the visual quality is reduced by scratches.

SUMMARY OF THE INVENTION

It is an object of the present invention to provide a method for hardening a metal sheet material, by means of which a particularly hard and scratch-resistant surface is produced on the metal sheet material.

This object is achieved according to the invention by a method for hardening a metal sheet material which comprises the following:

applying at least one peening stream to the metal sheet material, wherein at least one peening stream is applied to a front side of the metal sheet material and/or a rear side of the metal sheet material, respectively.

The present invention is therefore based on the concept of hardening the metal sheet material by means of peening, in particular, shot peening.

In this way, the hardness of the metal sheet material is increased purely through mechanical working.

Furthermore, a structure is preferably also introduced into the surface of the metal sheet material by the peening, by means of which the susceptibility of the surface to the occurrence of typical household scratches is reduced.

It can be provided that at least one peening stream is applied, in each case, to both a front side and also a rear side of the metal sheet material.

In order to keep distortion low during the working of the metal sheet material, it is favourable if at least one peening stream is applied, in each case, to the front side and the rear side of the metal sheet material at least at times simultaneously.

It is particularly favourable if at least one peening stream is applied simultaneously to the front side and the rear side, respectively, of the metal sheet material throughout the whole hardening process.

A so-called hotspot on the surface of the metal sheet material is associated with each peening stream.

The hotspot of a peening stream should be understood in this description and in the accompanying claims to be the smallest area, positionally fixed in relation to the respective associated peening stream, in the region of a surface of the metal sheet material within which 90% by weight of the peening material present within the respective peening stream impacts upon the metal sheet material.

If the peening stream is generated by means of a centrifugal wheel, the hotspot typically has the form of a rectangular strip.

If the peening stream is generated in another way, the hotspot can also be configured substantially circular.

In order to prevent distortions of the metal sheet material, it has proved to be favourable if a hotspot of a peening stream which is applied to the front side of the metal sheet material and a hotspot of a peening stream which is applied to the rear side of the metal sheet material overlap one another by at least 80%, preferably by at least 90%.

The metal sheet material to be hardened can be, in particular, in the form of a panel or a band material unwound from a metal sheet material roll.

Preferably, the metal sheet material has a mean thickness of not more than approximately 3 mm, in particular not more than approximately 2 mm, for example not more than approximately 1.5 mm.

In a preferred embodiment of the method according to the invention, it is provided that the metal sheet material is a stainless steel sheet material.

The stainless steel sheet material can particularly comprise a chrome-nickel stainless steel.

For example, the stainless steel sheet material can comprise the stainless steel with the material number 1.4301 in accordance with EN 10027-2.

Before applying the at least one peening stream, the metal sheet material preferably has a mean starting surface hardness of not more than approximately 200 HV.

The Vickers hardness in HV is determined by a hardness measurement in accordance with DIN EN ISO 5507-1.

After the application of the at least one peening stream, the metal sheet material preferably has a mean final surface hardness of at least approximately 300 HV, in particular at least approximately 400 HV, particularly preferably at least approximately 500 HV.

In order to achieve an optimum surface structure and a particularly high level of hardness, it is favourable if the at least one peening stream is generated from a peening material in which at least 50% by weight of the peening material has a largest particle diameter of at least 0.8 mm.

For a person skilled in the art, it is particularly surprising that a peening material with such a large grain size is particularly suitable for the peening of relatively thin metal sheet material since peening material with a large grain size leaves behind a particularly severe deformation on the metal sheet material. The trials carried out with a large grain size have shown, however, that with a peening material of this type, the desired surface structure and the desired surface hardening of the thin metal sheet material is achievable.

The device for carrying out the peening of the metal sheet material with peening material having such a large grain size must be capable of transporting and accelerating the heavy peening material. Furthermore, the impact area of the peening material on the metal sheet material should be controllable as accurately as possible, specifically preferably both on the front side and on the rear side of the metal sheet material.

It has also proved to be favourable if the at least one peening stream is generated from a peening material in which at least 50% by weight of the peening material has a largest particle diameter of not more than 1.0 mm.

The particles of the peening material are preferably formed substantially spherical.

It is particularly favourable if substantially all the particles of the peening material have a largest particle diameter in the region of approximately 0.2 mm to approximately 1.0 mm.

In a preferred embodiment of the invention, it is provided that the metal sheet material is moved relative to the peening stream during the application of the at least one peening stream.

If a stainless steel sheet material is used as the metal sheet material, the peened stainless steel sheet material has a grey-silver colour, similar to concrete or stone.

The surface of the peened stainless steel sheet material appears matt and used.

Due to the deliberately worn and used-looking concrete appearance with intentional signs of use, the peened stainless steel sheet material is suitable, in particular, for use in the field of industrial kitchens and "vintage kitchens".

Due to the surface hardening, the peened stainless steel sheet material is particularly scratch resistant.

The present invention further relates to a hardened metal sheet material.

It is a further object of the present invention to provide such a metal sheet material which has a particularly hard and scratch-resistant surface.

This object is achieved according to the invention by means of a metal sheet material according to claim 12 which has a front side which is surface-hardened by peening and/or a rear side which is surface-hardened by peening.

The metal sheet material according to the invention can have both a front side which is surface-hardened by peening and also a rear side which is surface-hardened by peening.

The material thickness of the metal sheet material is preferably not more than approximately 3 mm, particularly not more than approximately 2 mm, for example, not more than 1.5. mm.

In a preferred embodiment of the invention, it is provided that the metal sheet material is a stainless steel sheet material.

The metal sheet material according to the invention can be manufactured, in particular, by the method according to the invention for hardening a metal sheet material.

The metal sheet material according to the invention is suitable, in particular, for use in the manufacturing of a kitchen worktop panel, a sink unit or a basin, in particular a kitchen sink, for example, a single sink or a double sink or for manufacturing decorative surfaces, in particular in the field of facade design or interior design.

The present invention therefore also relates to a metal sheet product, in particular a kitchen worktop panel, a sink or a basin, in particular a kitchen sink, for example a single sink or a double sink or a decorative surface which comprises a metal sheet material according to the invention.

Further features and advantages of the invention are the subject matter of the following description and of the representation, in the drawings, of an exemplary embodiment.

The same or functionally equivalent elements are provided with the same reference signs in all the drawings.

DETAILED DESCRIPTION OF THE INVENTION

Figure 1:
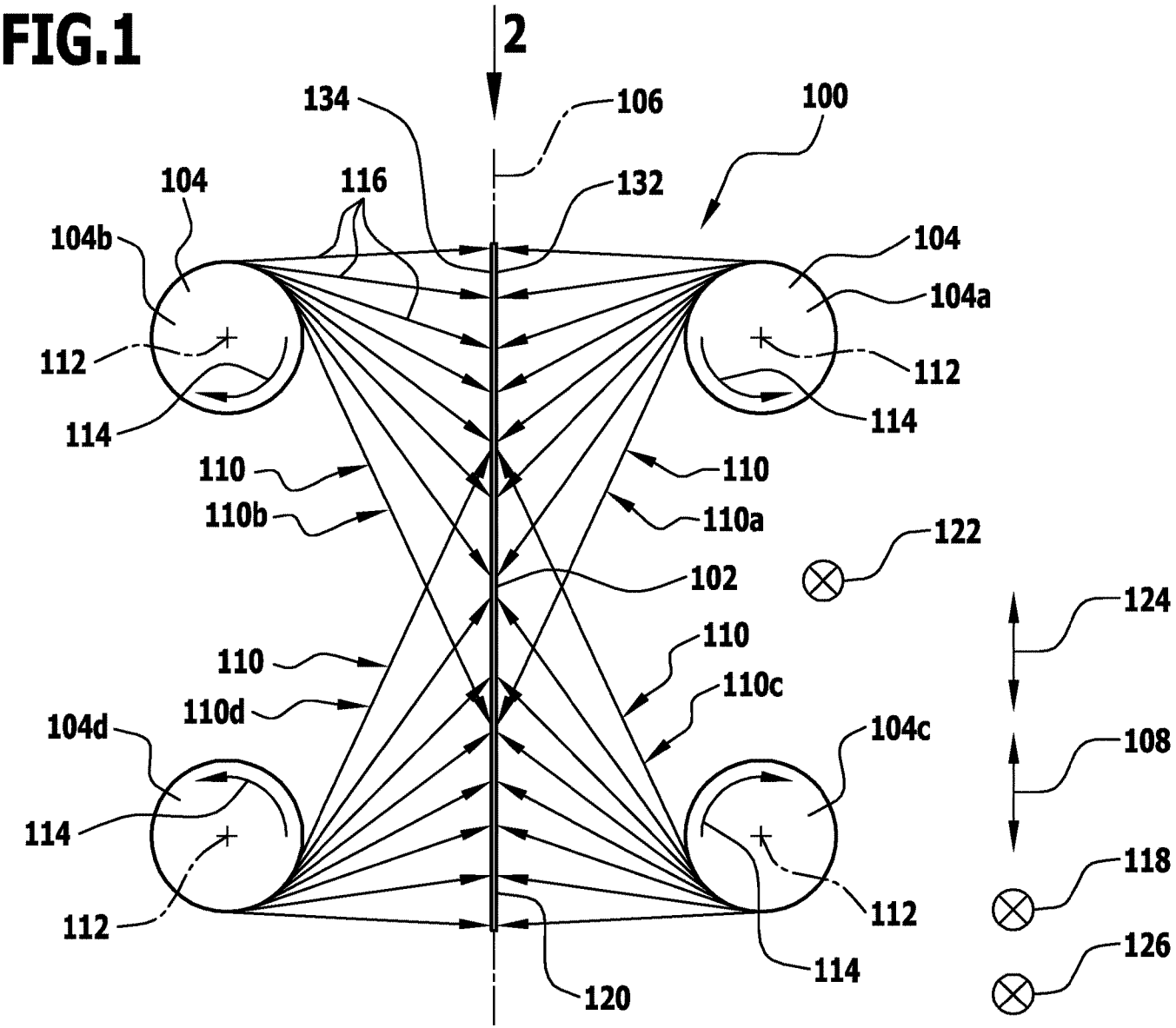
FIG. 1 shows a schematic side view of a device for peening a metal sheet material, wherein the device comprises two centrifugal wheels for applying peening streams to a front side of the metal sheet material and two centrifugal wheels for applying peening streams to a rear side of the metal sheet material.
Figure 2:
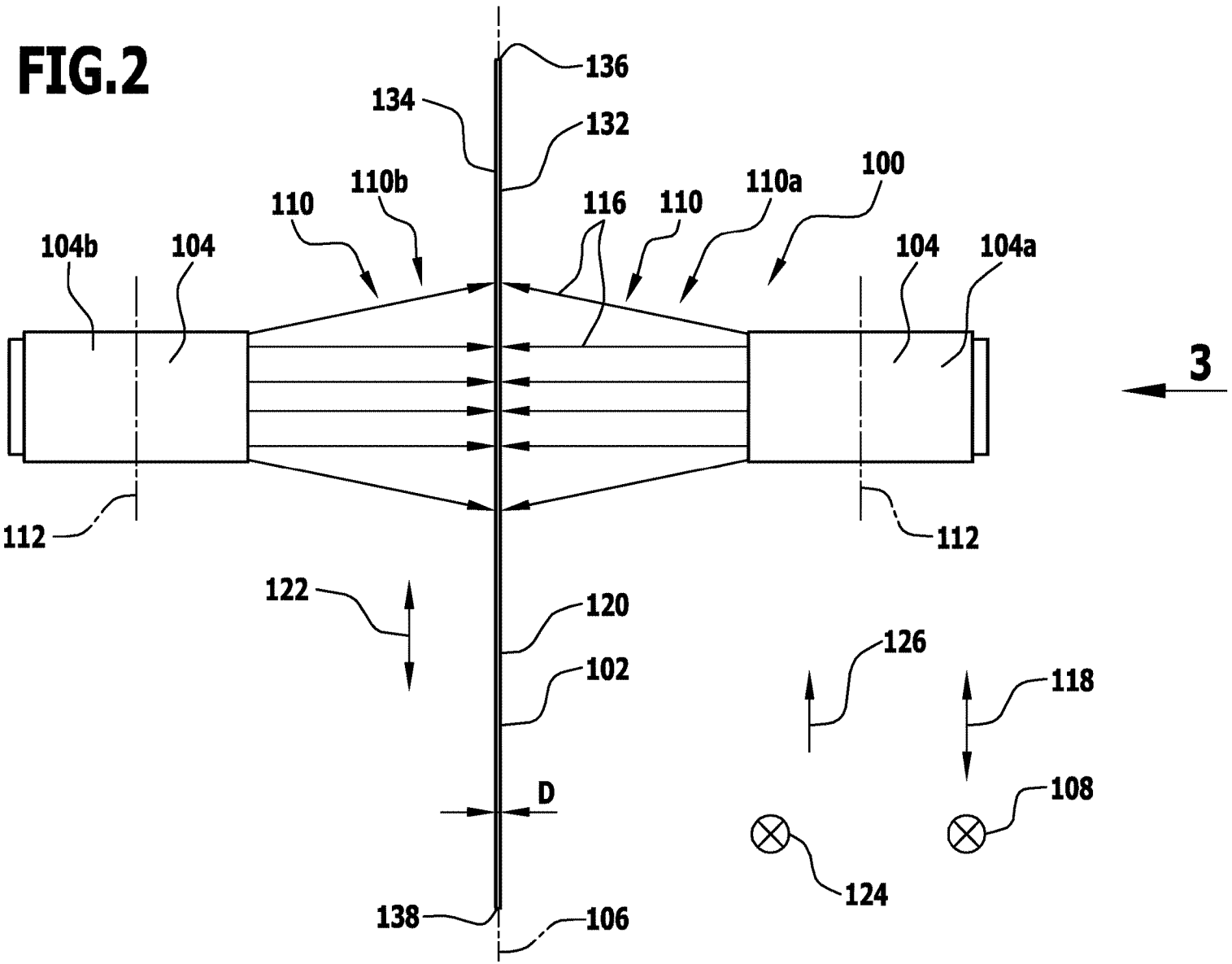
FIG. 2 shows a plan view from above of the device for peening the metal sheet material of FIG. 1, seen in the direction of the arrow 2 in FIG. 1.
Figure 3:
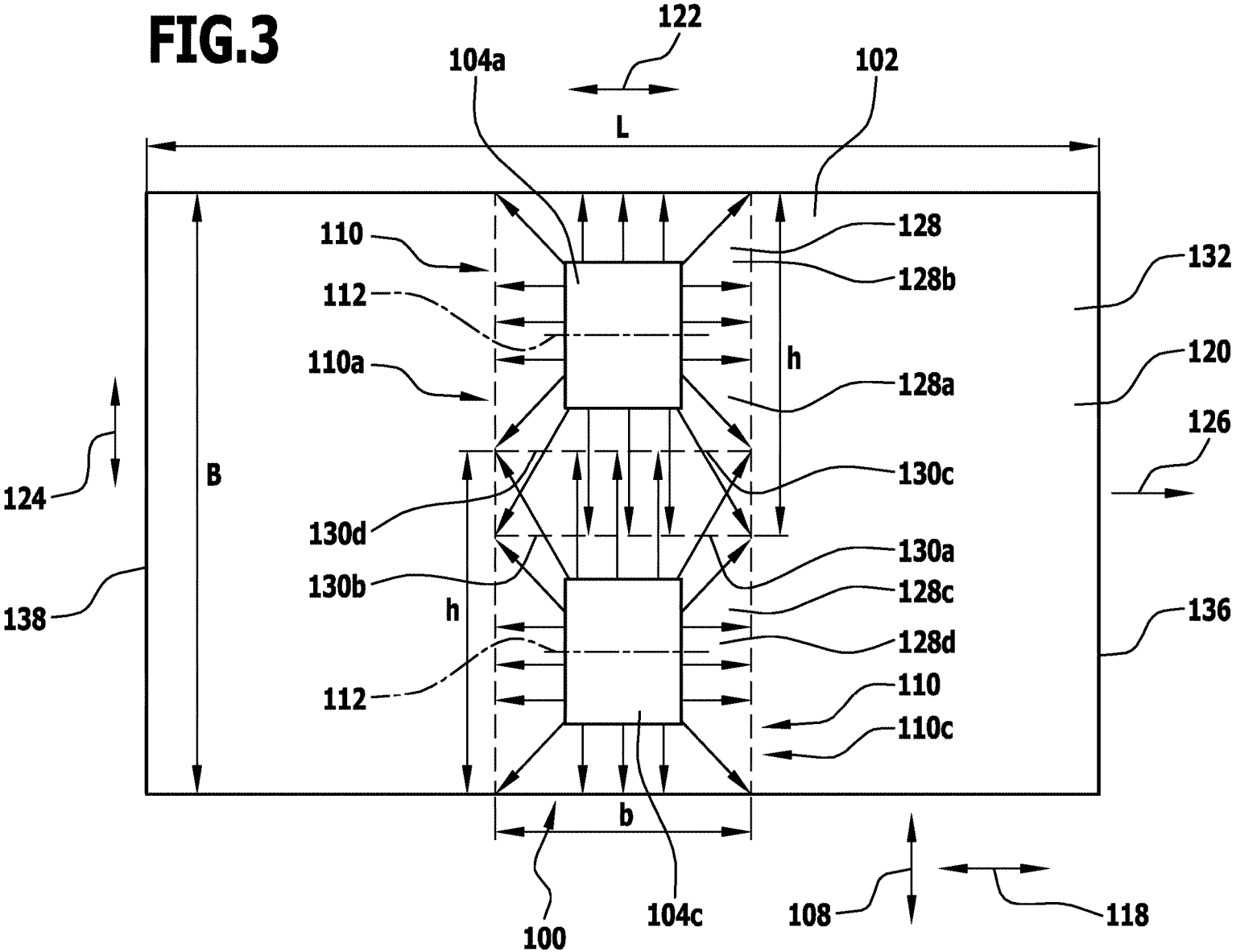
FIG. 3 shows a front view of the device for peening the metal sheet material of FIGS. 1 and 2, seen in the direction of the arrow 3 in FIGS. 1 and 2.

A device shown purely schematically in FIGS. 1 to 3, identified as a whole as 100 for peening a metal sheet material 102 comprises a plurality of, for example four, centrifugal wheels 104 which are arranged and oriented in pairs with mirror symmetry relative to a vertical transverse centre plane 106 of the device 100.

As is best seen from FIG. 1, in particular, two upper centrifugal wheels 104*a* and 104*b* are arranged with mirror symmetry relative to the vertical transverse centre plane 106 and two lower centrifugal wheels 104*c* and 104*d* spaced apart in the vertical direction 108 from the centrifugal wheels 104*a* and 104*b* are also arranged with mirror symmetry to one another relative to the vertical transverse centre plane 106.

Each of the centrifugal wheels 104 is capable of generating a peening stream 110 of peening material particles from a peening material which is fed to the respective centrifugal wheel 104 from a peening material store (not shown) by means of a peening material feed device (also not shown), said peening stream being directed toward the metal sheet material 102.

The centrifugal wheels 104*a* to 104*d* thus generate the peening streams 110*a* to 110*d*.

For this purpose, each centrifugal wheel 104 comprises a turbine rapidly rotating about a rotation axis 112, said turbine having a plurality of blades (not shown) which take up and accelerate the peening material fed in, wherein the centrifugal force acting on the also rotating peening material causes an outward acceleration of the peening material particles and then the ejection of the peening material particles over the respective blade edge out of the centrifugal wheel 104 with the hitherto transferred kinetic energy.

The rotation direction of the centrifugal wheels 104 is indicated in FIG. 1 by the arrows 114.

Exemplary trajectories of peening material particles following ejection from each centrifugal wheel 104 are shown in FIGS. 1 to 3 by the arrows 116.

The rotation axes 112 of the centrifugal wheels 104 are preferably substantially horizontal (that is, substantially parallel to the horizontal direction 118) and preferably substantially parallel to the vertical transverse centre plane 106 of the device 100 for peening.

The metal sheet material 102 to be treated is preferably configured as a substantially planar panel 120 which has a length L in its longitudinal direction 122 of, for example, approximately 3,000 mm to approximately 5,000 mm and a width B in its transverse direction 124 perpendicular to the longitudinal direction 122 of, for example, approximately 800 mm to approximately 2,000 mm.

Alternatively thereto, the metal sheet material 102 could also be configured as a continuous band material which is unrolled from a band material roll.

The mean gauge or thickness of the metal sheet material 102 is preferably not more than approximately 3 mm, in particular, not more than approximately 2 mm, for example, not more than approximately 1.5 mm.

Furthermore, the mean gauge or thickness D of the metal sheet material 102 is preferably at least approximately 0.5 mm, in particular, at least approximately 0.7 mm, for example, at least approximately 0.8 mm.

The metal sheet material 102 is preferably a stainless steel metal sheet material.

For example, the stainless steel with the material number 1.4301 in accordance with EN 10027-2 can be used as the metal sheet material 102.

This stainless steel material has the following chemical composition: 17.0% to 19.5% by weight of Cr; 8.0% to 10.5% by weight of Ni; a maximum of 0.07% by weight of C; a maximum of 1.0% by weight of Si; a maximum of 2.0% by weight of Mn; a maximum of 0.045% by weight of P; a maximum of 0.015% by weight of S; a maximum of 0.11% by weight of N; remainder Fe.

The starting surface hardness of this stainless steel sheet material before the peening is approximately 170 HV to approximately 180 HV.

The metal sheet material 102 is moved by means of a movement device (not shown) relative to the centrifugal wheels 104 of the device 100 along the vertical transverse centre plane 106 of the device 100.

The metal sheet material 102 is herein preferably fastened to the movement device so that its longitudinal direction 122 is oriented substantially parallel to the horizontal direction 118 and/or its transverse direction 124 is oriented substantially parallel to the vertical direction 108.

The movement of the metal sheet material 102 by means of the movement device takes place along a movement direction 126 which is oriented, for example, substantially horizontally.

It would also be possible to move the metal sheet material 102 relative to the centrifugal wheels 104 along a movement direction 126 which extends substantially vertically.

The feed speed with which the metal sheet material 102 is moved relative to the centrifugal wheels 104 amounts, for example, to approximately 1 m/min.

When the metal sheet material 102 is moved through between the centrifugal wheels 104, most of the peening material particles ejected by the centrifugal wheels 104 impact upon the metal sheet material 102 within a so-called hotspot 128 of the respective peening stream 110 on a front side 132 or a rear side 134 lying opposite the front side 132 of the metal sheet material 102.

The energy of the impacting peening material particles acting upon the respective surface of the metal sheet material 102 leads to a plastic deformation of the metal sheet material 102 with an associated increase of the dislocation density in the metal lattice of the layers close to the surface of the metal sheet material 102.

This strain hardening also finds expression in an increased condition of stress in the form of the so-called compressive internal stress which compensates for the tensional stresses present in the metal sheet material 102, counteracts external tension forces and thus increases the long-term strength of the metal sheet material 102 and resists crack formation and crack propagation.

The hotspot of a centrifugal wheel 104 should be understood in this description and in the accompanying claims to be smallest area positionally fixed in relation to the respective associated centrifugal wheel 104 in the region of a surface of the metal sheet material 102 within which 90% by weight of the peening material ejected by the respective centrifugal wheel 104 impacts upon the metal sheet material 102.

Each hotspot 128 has the form of a rectangular strip, wherein the width of the strip b, that is, its extent along the rotation axis 112 of the respective centrifugal wheel 104 or along the longitudinal direction 122 of the metal sheet material 102 can be, for example, approximately 10 cm, whilst its height h, that is, its extent perpendicular to the rotation axis 112 and/or parallel to the transverse direction 124 of the metal sheet material 102, can be, for example 150 cm (in FIGS. 1 to 3, the width b and the height h of a hotspot 128 are not represented to scale in the ratio of the length L and the width B of the metal sheet material 102).

As is best seen from FIG. 3, the centrifugal wheels 104*a* and 104*c* arranged over one another at the front side 132 of the metal sheet material 102 and the centrifugal wheels 104*b* and 104*d* arranged over one another at the rear side 134 of the metal sheet material 102 are arranged and oriented so that the hotspots 128*a* and 128*c* of the centrifugal wheels 104*a* and 104*c* cover the whole width B of the metal sheet material 102 in the vertical direction 108 and that the hotspots 128*b* and 128*d* of the centrifugal wheels 104*b* and 104*d* also substantially cover the whole width B of the metal sheet material 102 along the vertical direction 108.

The outer contours of the hotspots 128*a* and 128*c* are shown in FIG. 3 by the broken lines 130*a* and 130*c*.

The hotspots 128*a* and 128*c* of centrifugal wheels 104*a* and 104*c* arranged over one another can overlap one another; however, an overlap of this type is not essential.

In order to achieve the most homogeneous possible strain hardening of the metal sheet material 102, it is favourable if the overlap region of the hotspots 128*a* and 128*c* is as small as possible.

At the same time, in order to prevent a distortion of the relatively thin metal sheet material 102 during the peening, it is advantageous if the hotspots 128*a* and 128*b* of the upper centrifugal wheels 104*a* and 104*b* overlap one another as much as possible and also if the hotspots 128*c* and 128*d* of the lower centrifugal wheels 104*c* and 104*d* overlap one another as much as possible, so that the application of the peening streams 110 to the front side 132 and the rear side 134 of the metal sheet material 102 takes place as precisely as possible and simultaneously on both sides.

Preferably, the overlap region of the upper hotspots 128*a* and 128*b* is at east 90% of the area of the hotspot 128*a*.

Furthermore, the overlap region of the lower hotspots 128*c* and 128*d* is at least 90% of the area of the hotspot 128*c*.

Shown in FIG. 3 are the outer contours 130*b* and 130*d* of the hotspots 128*b* and 128*d*, drawn so that they coincide with the outer contours 130*a* and 130*c*, respectively, of the hotspots 128*a* and 128*c*, as corresponds to an ideal overlap of 100% between the hotspots 128*a*, 128*c* on the front side 132 of the metal sheet material 102 with the hotspots 128*b* and 128*d*, respectively, at the rear side 134 of the metal sheet material 102.

The application to the front side 132 and the rear side 134 of the metal sheet material 102 begins as soon as a first edge 136 of the metal sheet material 102 lying at the front in the movement direction 126 enters the region of the hotspot 128 and ends when a second edge 138 of the metal sheet material 102 lying at the rear leaves the region of the hotspot 128.

With a length L of the metal sheet material 102 of, for example, 4,600 mm and a feed speed of, for example, 1 m/min and a width of the hotspot 128 of 10 cm, the treatment time is therefore, for example, approximately 282 seconds.

The diameter of each centrifugal wheel 104 is, for example, approximately 380 mm.

Each centrifugal wheel 104 can have a turbine with, for example, six blades.

Each blade can have a blade width of, for example, 55 mm.

The ejection speed at which the peening material particles are ejected from the centrifugal wheel 104 can be, for example, approximately 88 m/s.

The peening material throughput per centrifugal wheel 104 can be, for example, approximately 200 kg/min.

The driving power of each centrifugal wheel 104 can be, for example, approximately 11 kW.

The stainless steel shot-blasting material which is sold under the name Chronital by the firm of Vulkan Inox GmbH Abrasive Technology, of Gottwaldstrasse 21, 45525 Hattingen, Germany can be used as the peening material.

This is a spherical stainless steel peening material with the following chemical composition: 18% by weight of Cr; 10% by weight of Ni; 1.8% by weight of Si; 1.2% by weight of Mn; 0.17% by weight of C; remainder Fe.

The peening material has an austenitic microstructure.

The bulk weight of the peening material is, for example, approximately 4.7 kg/dm$^3$.

The surface hardness of the peening material in the supplied state is, for example, approximately 300 HV and in the operation-ready mixture, for example, approximately 450 HV.

The operation-ready mixture for operation of the device 100 for peening is composed, for example, as follows:

50% by weight of particles with a diameter of 0.85 mm;
28% by weight of particles with a diameter of 0.60 mm;
11% by weight of particles with a diameter of 0.425 mm;
8% by weight of particles with a diameter of 0.36 mm;
3% by weight of particles with a diameter of 0.212 mm.

Following performance of the peening on the metal sheet material 102 with the material number 1.4301 and a material thickness of 1.0 mm, a width B of 1,500 mm and a length L of 4,000 mm and with the above-mentioned method parameters (in particular a feed speed of 1 m/min and a peening material throughput of 200 kg/min at each centrifugal wheel 104 and a rotation speed of 3,000 rpm), a measurement of the surface hardness (Vickers hardness measurement in accordance with DIN EN ISO 6507-1) at 18 points of the surface of the metal sheet material 102 resulted in a mean value of the surface hardness of 334 HV and a variation of the surface hardness from 233 HV to 453 HV.

The metal sheet material 102 surface hardened in the way described by means of the device 100 for peening can be used, in particular, for manufacturing sheet metal blanks for kitchen worktop panels or for manufacturing folding blanks for folded kitchen sinks, in particular, so-called zero-radius sinks.

The peened stainless steel sheet material has a grey-silver colour, similar to concrete or stone and preferably has no yellow tinge.

The surface of the peened stainless steel sheet material looks matt and used.

Due to the surface hardening, the peened stainless steel sheet material is, in particular, scratch resistant.

The peened stainless steel sheet material can be further processed by means of the usual techniques, in particular bending, welding and welding-in techniques.

The invention claimed is:

1. A metal sheet material comprising a front side which is surface-hardened by peening and a rear side which is surface-hardened by peening, wherein the metal sheet material is a stainless steel sheet material comprising 8% to 10.5% by weight of nickel, wherein the material thickness of the metal sheet material is not more than 1.5 mm and wherein the metal sheet material has a mean final surface hardness of at least 300 HV.

2. The metal sheet material according to claim 1, wherein the metal sheet material has a matt surface.

3. A metal sheet product, which is configured as a kitchen worktop panel, a sink or a basin and comprises a metal sheet material comprising a front side which is surface-hardened by peening and a rear side which is surface-hardened by peening, wherein the metal sheet material is a stainless steel sheet material comprising 8% to 10.5% by weight of nickel, wherein the material thickness of the metal sheet material is not more than 1.5 mm and wherein the metal sheet material has a mean final surface hardness of at least 300 HV.

4. The metal sheet material according to claim 1, wherein the stainless steel sheet material comprises the stainless steel with the material number 1.4301 in accordance with EN 10027-2.

5. The metal sheet material according to claim 1, wherein the metal sheet material has a mean final surface hardness of at least approximately 400 HV.

6. The metal sheet product according to claim 3, wherein the stainless steel sheet material comprises the stainless steel with the material number 1.4301 in accordance with EN 10027-2.

7. The metal sheet product according to claim 3, wherein the metal sheet material has a mean final surface hardness of at least 400 HV.

8. The metal sheet product according to claim 3, wherein the metal sheet material has a matt surface.

9. A method of forming a sheet metal product, comprising:

providing a metal sheet material as a starting material, wherein the metal sheet material comprises a front side which is surface-hardened by peening and a rear side which is surface-hardened by peening, wherein the metal sheet material is a stainless steel sheet material comprising 8% to 10.5% by weight of nickel, wherein the material thickness of the metal sheet material is not more than 1.5 mm and wherein the metal sheet material has a mean final surface hardness of at least 300 HV; and manufacturing a kitchen worktop panel, a sink or a basin from said starting material.

* * * * *